US010005086B2

(12) United States Patent
Vanella

(10) Patent No.: US 10,005,086 B2
(45) Date of Patent: Jun. 26, 2018

(54) EXHAUST OUTPUT PARTICULATE FILTRATION APPARATUS FOR COMBUSTION GASES, EXHAUST GASES

(71) Applicant: TECNOLOGICA S.A.S. DI VANELLA SALVATORE & C., Pesaro (IT)

(72) Inventor: Salvatore Vanella, Monteciccardo (IT)

(73) Assignee: TECNOLOGICA S.A.S DI VANELLA SALVATORE & C., Pesaro (IT)

( * ) Notice: Subject to any disclaimer, the term of this patent is extended or adjusted under 35 U.S.C. 154(b) by 0 days. days.

(21) Appl. No.: 14/765,655

(22) PCT Filed: Feb. 15, 2013

(86) PCT No.: PCT/IT2013/000049
§ 371 (c)(1),
(2) Date: Aug. 4, 2015

(87) PCT Pub. No.: WO2014/125511
PCT Pub. Date: Aug. 21, 2014

(65) Prior Publication Data

US 2015/0360233 A1 Dec. 17, 2015

(51) Int. Cl.
*B03C 3/12* (2006.01)
*B03C 3/41* (2006.01)
(Continued)

(52) U.S. Cl.
CPC ..... *B03C 3/12* (2013.01); *B03C 3/08* (2013.01); *B03C 3/09* (2013.01); *B03C 3/41* (2013.01);
(Continued)

(58) Field of Classification Search
CPC combination set(s) only.
See application file for complete search history.

(56) References Cited

U.S. PATENT DOCUMENTS 3,704,572 A * 12/1972 Gourdine ..... B03C 3/12 96/58
4,496,375 A 1/1985 Le Vantine
(Continued)

FOREIGN PATENT DOCUMENTS

CN 2482752 Y 3/2002
CN 104220174 A 12/2014
(Continued)

OTHER PUBLICATIONS

International Search Report for PCT/IT2013/0000 dated Oct. 24, 2013 (5 pages).
(Continued)

*Primary Examiner* — Robert A Hopkins
*Assistant Examiner* — Sonji Turner
(74) *Attorney, Agent, or Firm* — Abelman, Frayne & Schwab

(57) ABSTRACT

A particulate filtration apparatus for exhaust, combustion or other gases includes an enclosure for the output of a flow of such gases, prior to their release into the outside environment. An internal duct crossed by the flow and affected by a perforated conducting plate is kept at a negative electrical potential, for emission and dispersion in the duct of electrons coupled to polluting particles carried by the flow and substantially constituting the particulate, consequently giving them a negative electrical charge. Along the duct downstream of the perforated plate is an accumulation plate, kept at a positive electrical potential, for the attraction and stable adhesion of the electrically charged particles on the accumulation plate. A conducting filament at a negative electrical potential adjacent at least one opening of the perforated plate is a primary source of emission and dispersion of electrons which are coupled to particles carried by the flow.

14 Claims, 5 Drawing Sheets

(51) Int. Cl.
*B03C 3/47* (2006.01)
*B03C 3/08* (2006.01)
*B03C 3/09* (2006.01)

(52) U.S. Cl.
CPC ..... *B03C 3/47* (2013.01); *B03C 2201/06* (2013.01); *B03C 2201/10* (2013.01)

(56) References Cited

U.S. PATENT DOCUMENTS

| | | | | |
|---|---|---|---|---|
| 4,689,056 | A * | 8/1987 | Noguchi | B03C 3/12 96/79 |
| 5,492,557 | A * | 2/1996 | Vanella | B03C 3/017 422/121 |
| 5,622,543 | A * | 4/1997 | Yang | B03C 3/011 55/485 |
| 6,506,238 | B1 * | 1/2003 | Endo | B03C 3/12 96/79 |
| 7,267,712 | B2 * | 9/2007 | Chang | B03C 3/12 96/77 |
| 7,438,747 | B2 * | 10/2008 | Luo | H01T 23/00 361/226 |
| 7,473,304 | B2 * | 1/2009 | Besi | B01D 46/50 422/121 |
| 7,655,076 | B2 * | 2/2010 | Griffiths | B03C 3/011 96/64 |
| 7,976,616 | B2 * | 7/2011 | Alam | B03C 3/41 313/351 |
| 2006/0016335 | A1 | 1/2006 | Cox et al. | |
| 2008/0034973 | A1 * | 2/2008 | Griffiths | B03C 3/011 96/58 |
| 2010/0243885 | A1 | 9/2010 | Tepper et al. | |
| 2011/0115415 | A1 | 5/2011 | Hong | |
| 2011/0139009 | A1 | 6/2011 | Nakahara et al. | |
| 2011/0216467 | A1 | 9/2011 | Itani | |

FOREIGN PATENT DOCUMENTS

| | | | |
|---|---|---|---|
| EP | 1864840 | A1 | 12/2007 |
| JP | UM-32-7486 | B | 7/1957 |
| JP | 8-112549 | A | 5/1996 |
| JP | 2006500217 | | 1/2006 |
| WO | 2004033104 | A1 | 4/2004 |
| WO | 2005102535 | A1 | 11/2005 |
| WO | 2013153563 | A1 | 10/2013 |

OTHER PUBLICATIONS

Office Action in Corresponding Japanese Patent Application No. JP 2015-557574 dated Jul. 26, 2016 (13 pages).
Office Action in Corresponding Chinese Patent Application No. CN 104994959 dated Jun. 12, 2016 (3 pages).

* cited by examiner

EXHAUST OUTPUT PARTICULATE FILTRATION APPARATUS FOR COMBUSTION GASES, EXHAUST GASES

CROSS REFERENCE TO RELATED APPLICATION

This application is a national phase of Application No. PCT/IT2013/000049 filed Feb. 15, 2013, incorporated by reference in their entirety.

The present invention relates to a particulate filtration apparatus for combustion gases, exhaust gases and the like, and to the associated output circuit.

As is known, the combustion gases and exhaust gases emitted by internal combustion engines and by industrial plants or heating systems of various types (as well as from smokestacks, flues of industries, incinerators, etc.) are among the main culprits of atmospheric pollution.

Combustion gases and exhaust gases in fact usually carry fine particles of various sizes (which are indeed known as a whole as particulate) which remain suspended in the atmosphere and thus can be inhaled by people, with even severe consequences for their health.

More precisely, it is known that the smallest particles, with dimensions comprised between 10 nm and 100 nm, or even smaller than 10 nm, are extremely harmful due to their ability to enter the lungs until they settle and accumulate in the alveoli, carrying to them toxic substances of various kinds.

Moreover, the smallest particles, such as the ones cited above, are the ones found in the highest concentrations in the atmosphere, thus worsening the potential risk for people.

These drawbacks are partially solved by the device disclosed in patent application W02005/102535, filed Apr. 22, 2004 under PCT/IB2004/001388.

The above cited application in fact discloses a device that comprises an enclosure provided with a perforated grid, which has a preset negative value of electrical potential and is arranged so as to affect the flow of exhaust gases and combustion gases before they are released into the atmosphere.

The holes of the grid have specific configurations, so as to define with their edges a plurality of extensions or protrusions that are pointed, in order to facilitate the emission of electrons when the current flows, in order to charge the particles negatively as a consequence of their coupling to said electrons.

Downstream of the grid, inside the enclosure, there is a plurality of mutually parallel metal plates oriented along the flow advancement direction so as to define parallel ducts designed to be crossed by the particles.

The plates have alternately positive or negative electrical potentials, so as to generate an electrical field that diverts the particles toward the positively charged plates, where they accumulate, preventing release into the atmosphere and allowing easy removal by way of simple maintenance activities on said plate.

However, even this constructive solution is not devoid of drawbacks.

Over time, the device described above in fact has revealed unacceptable limitations in terms of effectiveness and efficiency in the filtration of polluting particulate (in particular ultrafine particulate): first of all, said device in fact has demonstrated the ability to capture and therefore remove particles comprised preferably between 500 nm and 3000 nm, but the quantity of these particles that is able to escape the filter remains nonetheless rather high.

Moreover, the device described above has been found to be ineffective against the finest particles (with dimensions comprised between 10 nm and 100 nm, or for ultrafine particles, with dimensions smaller than 10 nm), which vice versa, as observed in the foregoing, are the greatest danger for the health of people.

The aim of the present invention is to solve the problems described above, by providing an apparatus that has a high filtration effectiveness.

Within this aim, an object of the invention is to provide an output circuit that ensures the release into the outside environment of combustion gases and exhaust gases only after they have been filtered effectively.

Another object of the present invention is to provide an apparatus that is effective also against the finest particles, for example comprised between 10 nm and 100 nm, or below 10 nm.

A further object of the invention is to provide an apparatus that ensures high filtration capacities without requiring frequent maintenance and cleaning interventions.

A further object of the invention is to provide a filtration apparatus that ensures high reliability in operation.

Another object of the invention is to provide a filtration apparatus that can be obtained easily starting from commonly commercially available elements and materials.

Another object of the invention is to provide a filtration apparatus that has a low cost and is safe in application.

This aim, as well as these and other objects that will become better apparent hereinafter, are achieved by a particulate filtration apparatus for combustion gases, exhaust gases and the like, comprising an enclosure that can be arranged along an output circuit of a flow of exhaust gases, combustion gases and the like, prior to their release into the outside environment, said enclosure defining internally a duct that can be crossed by the flow and is affected by a perforated conducting plate, which is kept at a negative electrical potential, for the emission and dispersion in said duct of electrons that can be coupled to polluting particles that are carried by the flow and substantially constitute the particulate, consequently giving them a negative electrical charge, along said duct, downstream of said perforated plate, there being at least one accumulation plate, which is kept at a positive electrical potential, for the attraction and stable adhesion of the electrically charged particles on said accumulation plate, characterized in that it comprises at least one conducting filament, which is kept at a negative electrical potential and faces and is proximate to at least one respective opening of said perforated plate, in order to define a primary source of emission and dispersion of electrons, which can be coupled to the particles carried by the flow, substantially in the vicinity of their crossing of said opening.

This aim, as well as these and other objects, are also achieved by an output circuit for exhaust gases, combustion gases and the like, for their release into the outside environment, provided a with filtration apparatus for particulate, composed of polluting particles, carried by the flow of exhaust gases, combustion gases and the like, said apparatus comprising an enclosure that defines internally a duct that can be crossed by the flow and is affected by a perforated conducting plate, kept at a negative electrical potential, for the emission and the dispersion in said duct of electrons that can be coupled to polluting particles carried by the flow, consequently giving them a negative electrical charge, along said duct, downstream of said perforated plate, there being at least one accumulation plate, which is kept at a positive electrical potential, for the attraction and stable adhesion of the electrically charged particles on said accumulation plate, characterized in that it comprises at least one conducting filament, which is kept at a negative electrical potential and faces and is proximate to at least one respective opening of said perforated plate, in order to define a primary source of emission and dispersion of electrons, which can be coupled to the particles carried by the flow, substantially proximate to their crossing of said opening.

Further characteristics and advantages of the invention will become better apparent from the description of three preferred but not exclusive embodiments of the filtration apparatus and of the circuit according to the invention, illustrated by way of nonlimiting example in the accompanying drawings, wherein.

Figure 1:
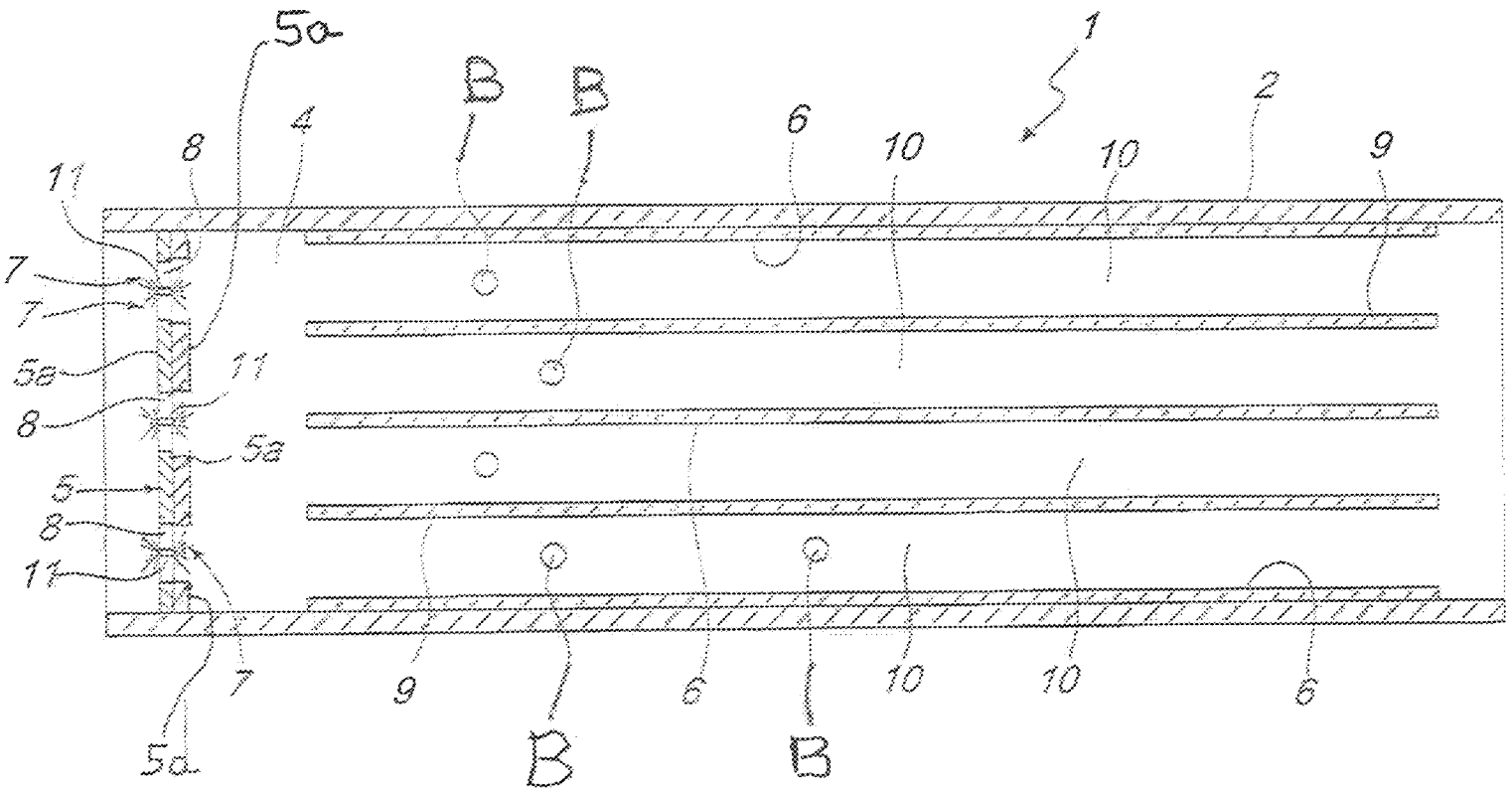
FIG. 1 is a schematic sectional side view, taken along an axial plane, of the filtration apparatus according to the invention in the first embodiment.

With particular reference to the figures, the reference numeral 1 generally designates a particulate filtration apparatus, which comprises an enclosure 2 that can be arranged along an output circuits 3 of a flow of exhaust gases, combustion gases and the like prior to their release into the outside environment.

Such exhaust gases and combustion gases can be emitted by internal combustion engines and by industrial plants A or heating systems of various types, but also by smokestacks, flues of industries, incinerators, etc.; in any case, as will be described in detail in the pages that follow, the apparatus 1 is capable of acting on said flow in order to remove from it the particulate, i.e., as is known, the set of fine particles B (solid or also liquid, and typically highly polluting) dispersed in the flow and carried by it.

It is specified from the outset that this use is a preferred application of the apparatus 1 according to the invention, and that constant reference shall be made thereto in the continuation of the present description without however excluding use of the apparatus 1 for the filtration of different flows of gaseous substances, as a function of the specific requirements, without thereby abandoning the protective scope claimed herein.

The enclosure 2 defines internally a duct 4 that can be crossed by the flow and affected by a perforated conducting plate 5, which is kept at a negative electrical potential (the value whereof, optionally variable over time, can be selected at will according to the specific requirements), so that it can emit and disperse into the duct 4 electrons that can be coupled to the polluting particles B that are carried by the flow and, as shown, substantially constitute the particulate.

As a consequence of the coupling with the electrons, the particles B are given a negative electrical charge, allowing them to be attracted and to stably adhere on at least one accumulation plate 6, which is arranged along the duct 4, downstream of the perforated plates 5, and is kept for this purpose at a positive electrical potential.

It is noted that the enclosure 2 can be constituted by a tubular sleeve that can be inserted coaxially along the circuit 3 or can be defined by a portion thereof. Vice versa, in the constructive solutions proposed merely by way of example in the accompanying figures, the enclosure 2 is shaped substantially like a parallelepiped and, installed along the output circuit 3 of the exhaust gases and combustion gases, forces them to flow along the duct 4 and therefore to pass through the perforated plate 5 before being released into the atmosphere or in any case outside.

According to the invention, the filtration apparatus 1 comprises at least one conducting filament 7, which is kept at a negative electrical potential, which is optionally equal to the potential of the perforated plate 5, and faces and is proximate to at least one respective opening 8 of the perforated plate 5, in order to define a primary and privileged source of emission and dispersion of electrons, which can be coupled to the particles B carried by the flow, substantially proximate to their crossing of the opening 8.

Conveniently, in order to better direct the electrically charged particles B toward the accumulation plate 6, the filtration apparatus 1 according to the invention comprises at least one deflection plate 9, which is kept at a negative electrical potential (optionally equal to the potential at which the filament 7 and/or the perforated plate 5 are kept): the accumulation plate 6 and the deflection plate 9 are arranged along the axis of the duct 4 and in a substantially mutually parallel arrangement, in order to generate an electrical field inside the duct 4 and consequently facilitate the sending and the adhesion of the electrically charged particles B on the accumulation plate 6.

More particularly, as can be seen for example in FIG. 1, the filtration apparatus 1 according to the invention comprises a plurality of accumulation plates 6 and of deflection plates 9, which are arranged alternately along the axis of the duct 4 in a substantially mutually parallel arrangement, in order to define respective interspaces 10 (for example three, as proposed by way of example in FIG. 1), which are thus crossed by the flow that carries the charged particles B.

Conveniently, the filtration apparatus 1 according to the invention comprises at least one first conducting filament 7, which is kept at a negative electrical potential, faces and is proximate to the opening 8 and is arranged downstream of the plate 5 (and therefore of the opening 8), and at least one second conducting filament 7, which is kept at a negative electrical potential and faces and is proximate to the opening 8 and arranged upstream of the plate 5 (and therefore of the opening 8).

Figure 5:
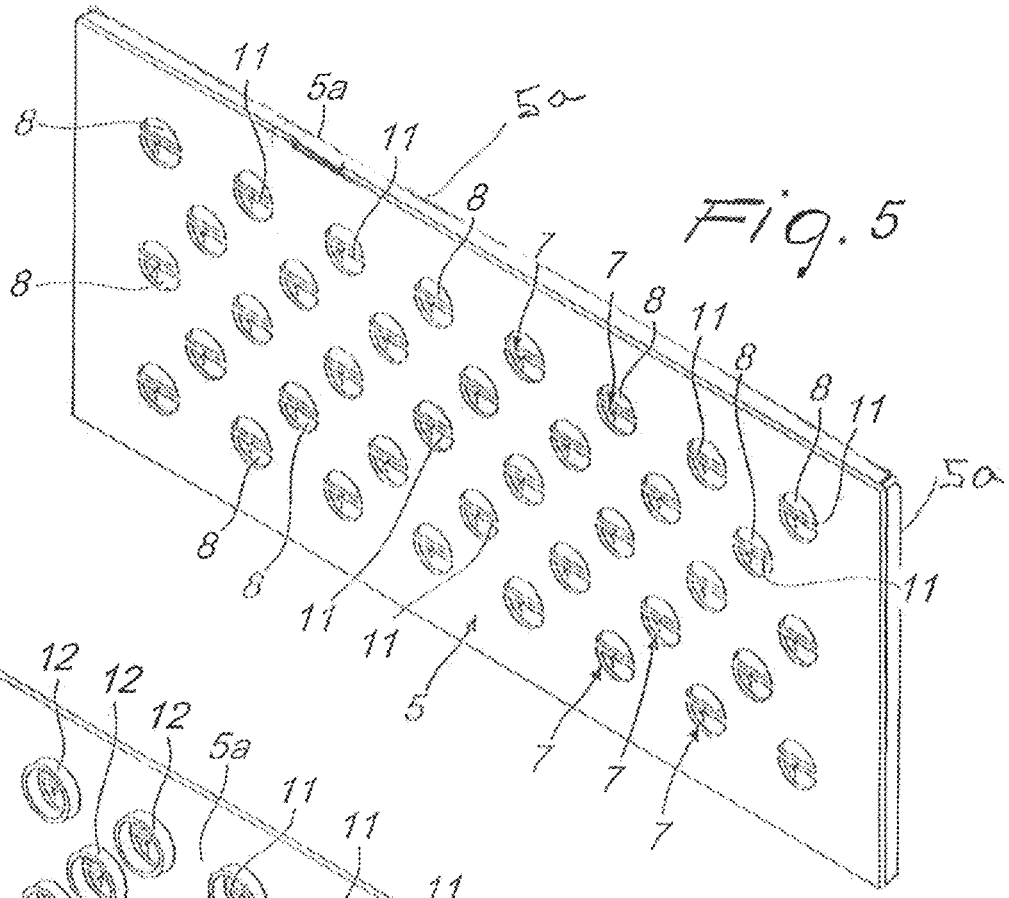
FIG. 5 is a perspective view of the plate in the second embodiment.

Therefore, the protective scope claimed herein includes constructive solutions in which at least one filament 7 is arranged only downstream (or only upstream) of the plate 5 (substantially as in FIG. 5), as well as (preferred) constructive solutions in which at least one filament 7 is arranged upstream of the plate 5 and at least one filament 7 is arranged downstream thereof.

More particularly, in the preferred constructive solution, cited by way of nonlimiting example of the application of the invention, the plate 5 comprises a plurality of openings 8 (as indeed in the examples shown in the accompanying figures), each of which is faced and proximate to at least one respective conducting filament 7, kept at a negative electrical potential.

Even more particularly, and with further reference to the preferred constructive solution, the filtration apparatus 1 comprises a respective plurality of filaments 7 of variable length, which faces and is proximate to each opening 8, as proposed by way of example in the accompanying figures.

In practice, therefore, the entire mass of exhaust gases or combustion gases that flows along the duct 4 is forced to pass through the perforated plate 5 at one of its openings 8, proximate to which there is a plurality of filaments 7 capable of dispersing in the immediate vicinity an extremely large number of electrons: the apparatus 1 according to the invention ensures an extremely high effectiveness, since the flow of exhaust gases and combustion gases is forced to travel through the region in which the electron emission is highest, thus ensuring the coupling of said electrons with a very large number of particles B of pollutants A.

In a constructive solution of substantial practical interest, which does not limit the application of the invention, each filament 7, preferably made of metallic material, is of the multicore type; moreover, each filament 7 has a first fixed end 7*a*, which is fixed rigidly to the perforated plates 5 (in various manners, one of which will be described in detail in the paragraphs that follow) and, at the opposite end, a second free end 7*b*, which is spaced from the plate 5 and is preferably wedge-shaped, in order to ensure optimum emission and dispersion of the electrons (indeed thanks to the substantially pointed shape of the filaments 7).

In the embodiments proposed merely by way of example in the accompanying figures, each opening 8 has a substantially circular shape and is crossed by a diametrical rib 11: the fixed ends 7*a* of each filament 7 can thus be fixed to the respective perforated plate 5 indeed at said rib 11.

Advantageously, the filtration apparatus 1 according to the invention comprises a guiding element 5, 5*a*, which in turn is arranged proximate to the openings 8 and is kept at a different electrical potential (for example equal to the ground potential), with respect to the electrical potential of the filaments 7, in order to impose on the electrons emitted by the filaments 7 (and intended to couple to the polluting particles B) a predefined trajectory that indeed leads toward said element.

More particularly, in a first constructive variation, the guiding element is substantially constituted by at least one metallic covering film (made for example of copper), which can be applied to at least one respective face 5*a* (or on both) of the perforated plate 5 (covering it completely or partially): in this manner, in practice, it is possible to impose on the electrons emitted by the filaments 7 a predefined trajectory that leads to the perforated plate 5, and since the face 5*a* is arranged at a different axial height than the free ends 7*b* of the filaments 7, the electrons released by the latter follow a trajectory that has a first portion that is perpendicular to the advancement direction of the flow of exhaust gases and combustion gases, while subsequently the direction tends to assume an orientation that is perpendicular to the plate 5 (and to the face 5*a* to which the film that attracts the electrons is applied) and therefore parallel to the flow advancement direction.

In a second constructive variation, the guiding element is constituted substantially by a metallic net, which is arranged in a parallel configuration proximate to the plate 5 and toward which the electrons emitted by the filaments 7 (and by the plate 5) can thus be attracted.

If the filaments 7 are arranged only downstream, or only upstream of the plate 5, correspondingly the metallic net can be arranged only downstream or only upstream of said plate 5; if instead the filaments 7 are arranged both downstream and upstream of the plate 5, the apparatus 1 according to the invention is provided with one metallic net or two metallic nets arranged conveniently both downstream and upstream of said plate 5.

Figure 6:
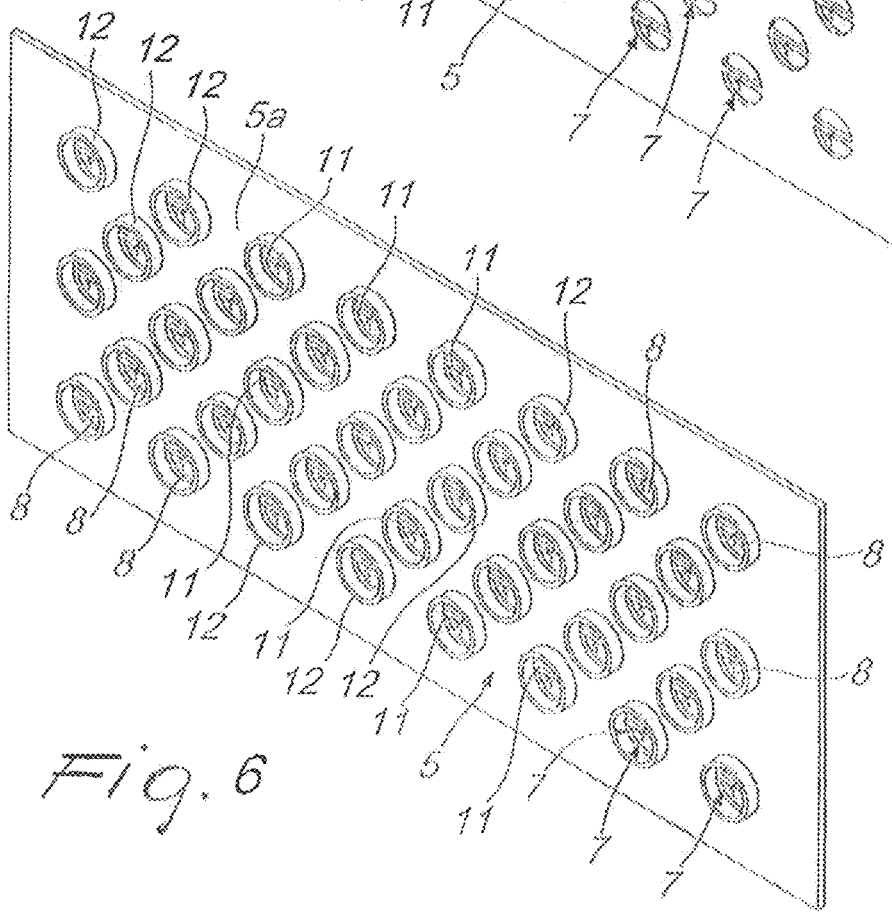
FIG. 6 is a perspective view of the plate in the third embodiment.
Figure 7:
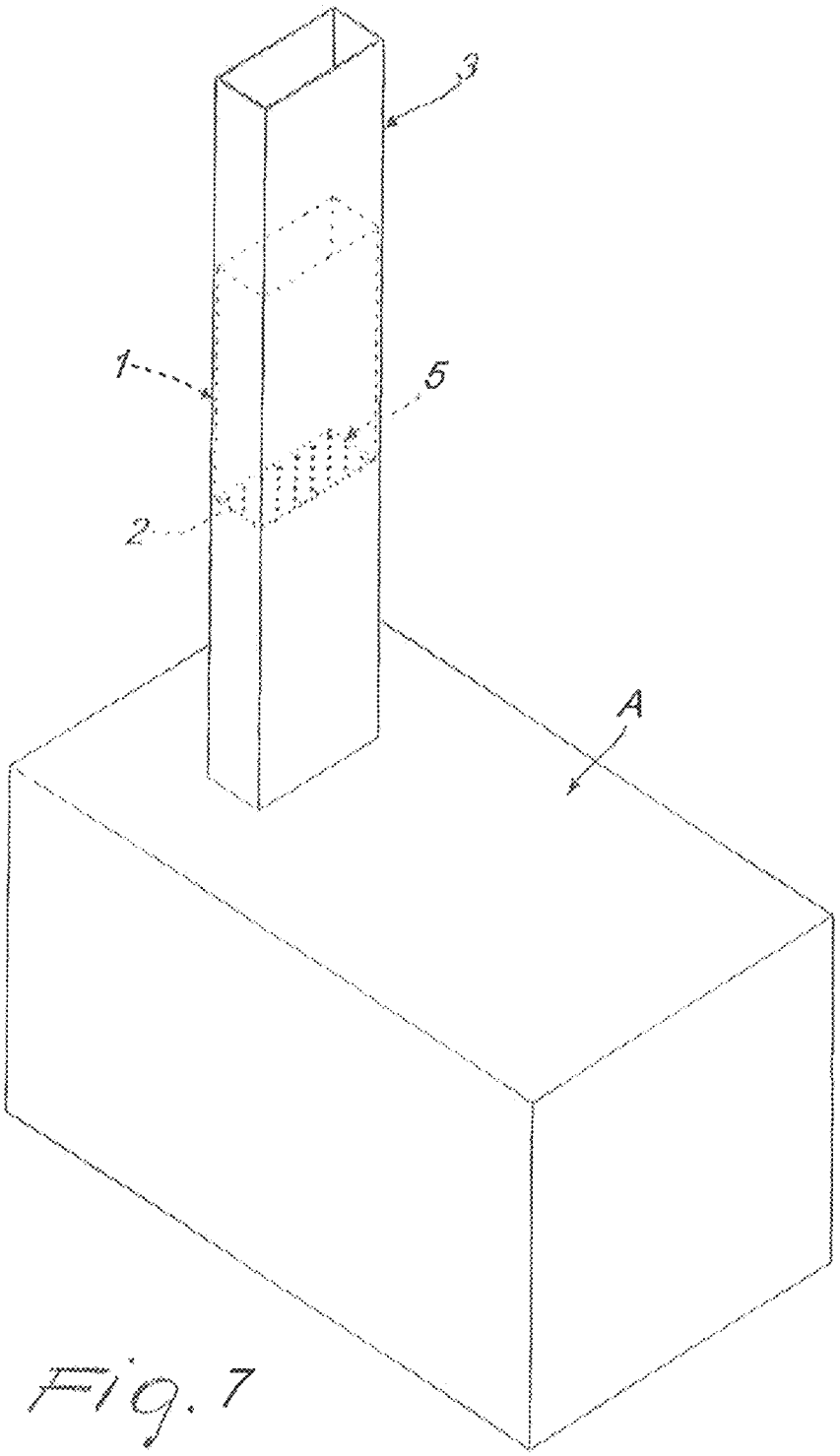
FIG. 7 is a schematic perspective view of a possible application of the apparatus and of the circuit according to the invention.

In a further constructive variation (illustrated by way of example in FIG. 6), each opening 8 has a respective raised cylindrical border 12 that protrudes from the edge of the openings 8.

In this constructive variation, the orientation elements are constituted by a covering layer of the top of each border 12, said border 12 having a greater axial extension than the length of the filaments 7 (as indeed can be seen from FIG. 6), so that the predefined trajectory imposed on the electrons emitted by the filaments 7 has at least one portion that is substantially parallel to the flow advancement direction (and is directed in the same manner), in order to increase the contact time between the electrons attracted toward the top of the border 12 and said flow of exhaust gases and combustion gases in order to facilitate the coupling between the electrons and the polluting particles B.

Figure 2:
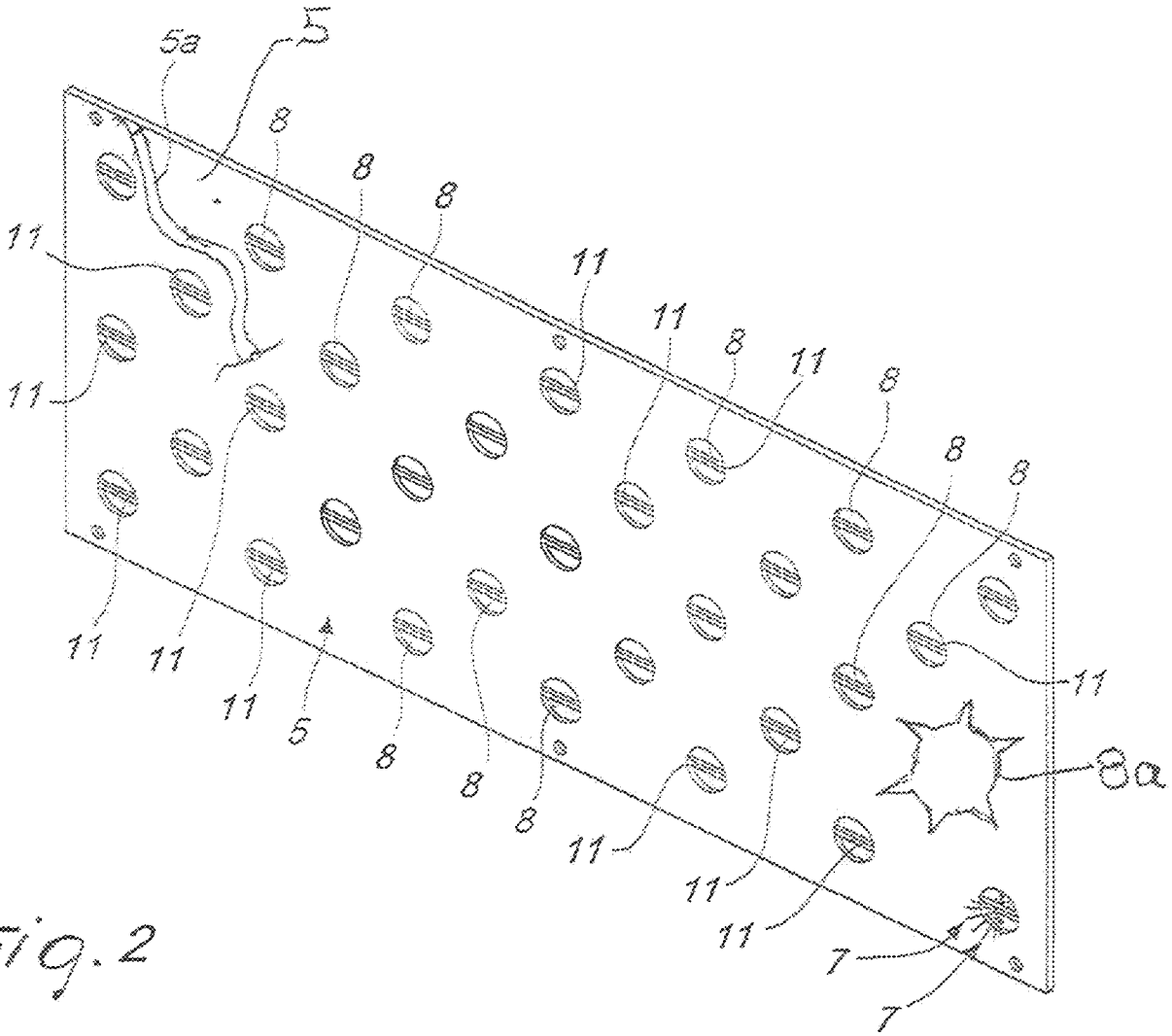
FIG. 2 is a schematic perspective view of the plate in the first embodiment.
Figure 3:
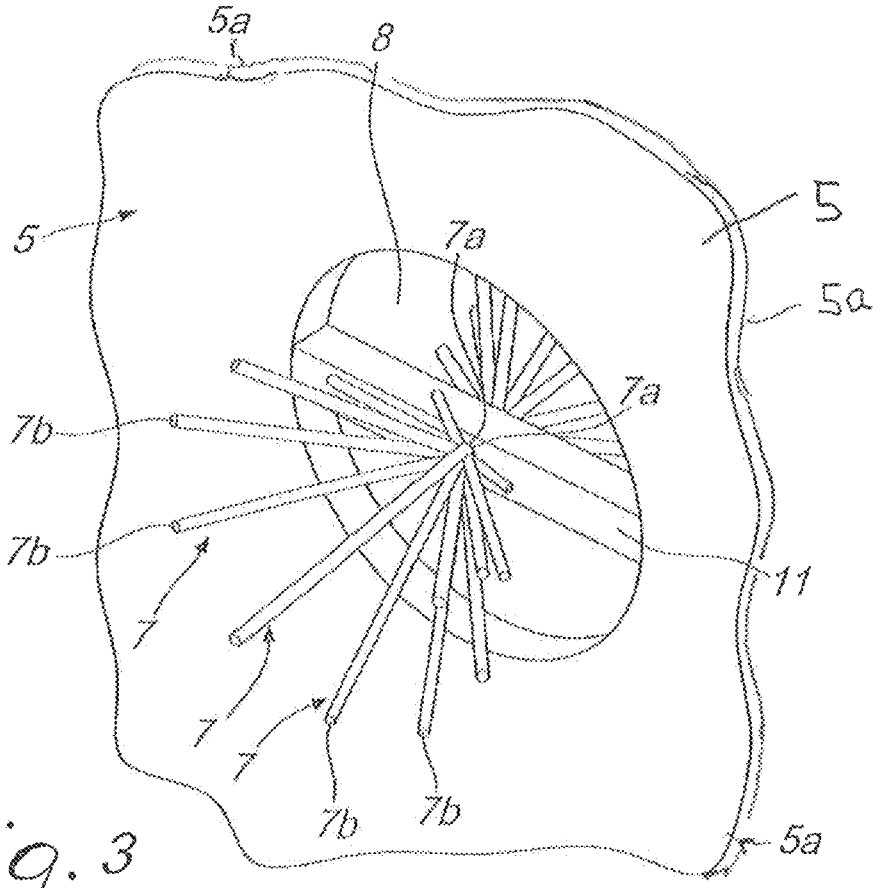
FIG. 3 is a highly enlarged-scale perspective view of a detail of the apparatus of FIG. 1.
Figure 4:
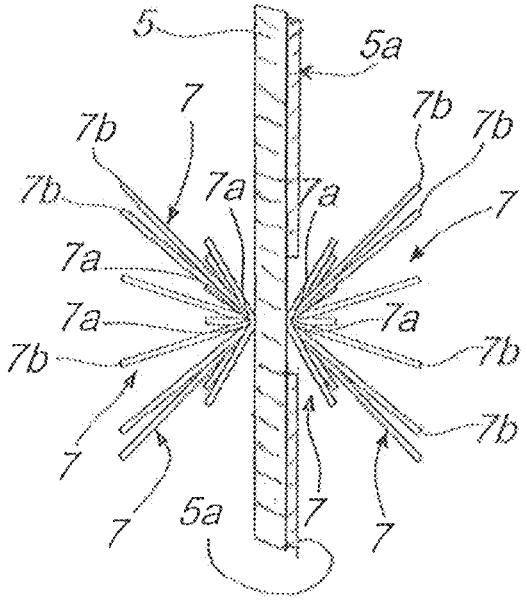
FIG. 4 is a side view of the detail of FIG. 3.

In a different constructive variation, which does not exhaust the ways of carrying out the apparatus 1 according to the invention and in any case within the protective scope claimed herein, each opening 8*a* seen in FIG. 2 has a star-like shape, so as to define a plurality of pointed tabs, at which the emission and dispersion of the electrons are increased further.

The circuit for the output of exhaust gases, combustion gases and the like, in order to allow their release into the outside environment, is provided with a particulate filtration apparatus 1, composed of polluting particles B carried by the flow of exhaust gases, combustion gases and the like. Said apparatus 1 comprises an enclosure 2 that defines internally a duct 4 that can be crossed by the flow and is affected by a perforated plate 5, which is kept at a negative electrical potential, in order to emit and disperse in the duct 4 electrons, which can thus couple to polluting particles B, carried by the flow, in order to give them a negative electrical charge.

Along the duct 4, downstream of the perforated plate 5, there is at least one accumulation plate 6, which is kept at a positive electrical potential, for the attraction and stable adhesion of the electrically charged particles B.

According to the invention, the output circuit 3 comprises at least one conducting filament 7, which is kept at a negative electrical potential and faces and is proximate to at least one respective opening 8 of the perforated plate 5, so as to define a primary source of emission and dispersion of electrons, which can couple to the particles B carried by the flow, after crossing the opening 8.

Operation of the apparatus according to the invention is as follows.

The apparatus 1 can be installed along an output circuit 3 (or coincide with a portion thereof) designed to expel into the atmosphere exhaust gases and combustion gases that carry polluting particles B of various types (known typically as particulate).

The exhaust gases or combustion gases travel along the duct 4 and pass the perforated plate 5, crossing the openings 8, proximate to which, as shown, the filaments 7 are arranged, constituting a primary and privileged source of an emission of electrons (which are also emitted by the plate 5, since both are kept at a negative electrical potential).

The presence of the filaments 7 proximate to the openings 8 (upstream and/or downstream thereof) ensures that the entire mass of exhaust gases or combustion gases that constitutes the flow passes through the region of space in which the emission of electrons is highest, allowing a very large number of particles B to couple to the electrons, thus acquiring a negative electrical charge (an effect which besides is facilitated, as mentioned, by the presence of the guiding element, which allows to define at will the trajectory of the electrons).

Downstream of the plate 5, the negatively charged particles B are thus affected by the electrical field generated by the accumulation plates 6 (which are positively charged), which face the deflection plates 9 (which are negatively charged): the particles B thus fall and are deposited, adhering stably thereto, on the accumulation plates 6 before the exhaust gases and combustion gases are released externally, reducing or fully eliminating the presence of particulate of any size emitted into the atmosphere, with far higher efficiencies than obtainable with known types of filtration devices.

Indeed the high filtration effectiveness, achieved in the manner described above, allows the apparatus 1 according to the invention to prove to be effective also against the finest particles B, for example comprised between 10 am and 100 nm, or even for particulate with ultrafine dimensions, i.e., smaller than 10 nm, thus achieving a result that is entirely unattainable by adopting known filtration assemblies.

Moreover, it is evident that the cleaning/maintenance interventions required by the filtration apparatus 1 are extremely easy and short-lasting, since it is sufficient to clean periodically the exposed surfaces of the accumulation plate 6 in order to remove the particulate deposited thereon.

In this regard it is useful, moreover, to note that there is no danger that the particles B, after adhering to the accumulation plate 6, might somehow detach: therefore, cleaning interventions can be performed with a very low periodicity, with further benefits in terms of expenditure of time and money.

In practice it has been found that the filtration apparatus and the circuit according to the invention achieve fully the intended aim, since the use of at least one conducting filament, kept at a negative electrical potential in order to define a primary source of emission and dispersion of electrons, and arranged so as to face and be proximate to at least one respective opening of a perforated plate, also kept at a negative electrical potential, to emit and disperse in turn electrons that can couple to polluting particles, consequently giving them a negative electrical charge, in order to facilitate their adhesion to an accumulation plate that is kept at a positive electrical potential, allows to provide an apparatus and a circuit having a high filtration effectiveness.

The invention thus conceived is susceptible of numerous modifications and variations, all of which are within the scope of the accompanying claims; all the details may further be replaced with other technically equivalent elements.

For example, the apparatus 1 can be provided with a number at will of accumulation plates 5, which are arranged for example in series in the duct 4 (and followed by respective plates 6, 9).

Moreover, the inner walls of the enclosure 2 can be covered with a sheet of insulating material (which therefore is interposed between said walls and said plates 6, 9).

In the exemplary embodiments shown, individual characteristics, given in relation to specific examples, may actually be interchanged with other different characteristics that exist in other exemplary embodiments.

In practice the materials used, as well as the dimensions, may be any according to requirements and to the state of the art.

Where technical features mentioned in any claim are followed by reference signs, those reference signs have been included for the sole purpose of increasing the intelligibility of the claims and accordingly such reference signs do not have any limiting effect on the interpretation of each element identified by way of example by such reference signs.

The invention claimed is:

1. A particulate filtration apparatus, for exhaust gases, combustion gases, including an enclosure arranged along a circuit for output flow of exhaust gases, combustion gases, prior to their release into an outside environment, said enclosure defining (a) internally a duct through which travels output flow which flow is affected by a perforated conducting plate perforated by openings maintained at a negative electrical potential, for emission and dispersion in said duct of electrons be coupled to polluting particles carried by the flow and substantially constituting particulate, consequently giving them a negative electrical charge, and (b) along said duct downstream of said perforated conducting plate, at least one accumulation plate, which is maintained at a positive electrical potential, for attraction and stable adhesion of electrically charged particles on said accumulation plate, comprising (i) at least one conducting filament, which is maintained at a negative electrical potential and faces and is proximate to at least one respective opening of said perforated plate, in order to define a primary source of emission and dispersion of electrons, coupled to the particles carried by the flow, substantially proximate to their crossing of said opening and (ii) at least one guiding element, which is arranged proximate to said openings in said perforated plate and is maintained at a different electrical potential with respect to the electrical potential of said at least one conducting filament, in order to impose on the electrons emitted by said at least one conducting filament a predefined trajectory that leads towards said guiding element.

2. The filtration apparatus according to claim 1, comprising at least one deflection plate, maintained at a negative electrical potential, said accumulation plate and said at least one deflection plate along an axis of said duct in a parallel arrangement, in order to generate an electrical field inside said duct, with consequent sending and adhesion of the electrically charged particles on said at least one accumulation plate.

3. The filtration apparatus according to claim 2, characterized in that it comprises a plurality of said accumulation plates and a plurality of said at least one deflection plates, arranged alternately along said axis of said duct in a substantially mutually parallel arrangement, in order to define respective interspaces that crossed by the flow that carries the electrically charged particles.

4. The filtration apparatus according to claim 1, comprising at least one first conducting filament, maintained at a negative electrical potential, which faces and is proximate to said at least one opening and is arranged downstream of said perforated plate, and at least one second conducting filament, maintained at a negative electrical potential, which faces and is proximate to said at least one opening and is arranged upstream of said perforated plate.

5. The filtration apparatus according to claim 1, wherein said perforated plate comprises a plurality of said openings, each one of said openings facing and being proximate to at least one of said first and second conducting filaments, maintained at a negative electrical potential.

6. The filtration apparatus according to claim 1, comprising a respective plurality of first and second conducting filaments with variable lengths, which face and are proximate to each one of said openings.

7. The filtration apparatus according to claim 1, wherein each one of first and second conducting filaments is a multicore type.

8. The filtration apparatus according to claim 1, wherein each one of first and second conducting filaments has a first end, which is fixed rigidly to said perforated plate and, an opposite free end, spaced from said perforated plate and is preferably wedge-shaped, for optimum emission and dispersion of the electrons.

9. The filtration apparatus according to claim 1, wherein each one of said openings in said conducting plate has a substantially circular shape and is crossed by a diametrical rib, said fixed end of each one of said filaments having one end being fixed to a respective said perforated plate at said rib.

10. The filtration apparatus according to claim 1, wherein said at least one guiding element is constituted substantially by at least one metallic covering film, which is applied to at least one respective face of said perforated plate, in order to impose on the electrons emitted by said at least one conducting filament a predefined trajectory that leads toward said perforated plate.

11. The filtration apparatus according to claim 1, wherein said at least one guiding element is constituted substantially by at least one metallic net, which is arranged parallel and proximate to said perforated plate.

12. The filtration apparatus according to claim 1, wherein each one of said openings has a respective raised cylindrical border, which protrudes from the edge of said openings, said guiding elements being constituted by a covering layer of the top of each one of said borders, having a greater axial extension than the length of said filaments.

13. The filtration apparatus according to claim 1, wherein each one of said openings has a star-like shape, in order to define a plurality of pointed tabs, to further increase of the emission and dispersion of the electrons.

14. An output circuit for exhaust gases, combustion gases, for their release into an outside environment, provided with an apparatus for filtering particulate, composed of polluting particles, carried by a flow of exhaust gases or combustion gases, a apparatus including (a) an enclosure that defines internally a duct through which travels said output flow, which flow is affected by a perforated conducting plate perforated by openings, maintained at a negative electrical potential, for emission and dispersion in said duct of electrons coupled to polluting particles carried by said output flow, consequently giving said polluting particles a negative electrical charge, along said duct, downstream of said perforated conducting plate, and (b) at least one accumulation plate, maintained at a positive electrical potential, for attraction and stable adhesion of electrically charged particles on said accumulation plate, comprising (i) at least one conducting filament, maintained at a negative electrical potential and facing and being proximate to at least one respective opening of said perforated plate, in order to define a primary source of emission and dispersion of electrons, coupled to the particles carried by the flow, substantially proximate to their crossing of said opening and (ii) guiding element, which is arranged proximate to said openings in said perforated plate and is maintained at a different electrical potential with respect to the electrical potential of said at least one conducting filament, in order to impose on the electrons emitted by said at least one conducting filament a predefined trajectory that leads towards said guiding element.

* * * * *